US005350294A

United States Patent [19]

Iwahori

[11] Patent Number: 5,350,294

[45] Date of Patent: Sep. 27, 1994

[54] LIGHTER

[76] Inventor: Masayuki Iwahori, 15-19 Nakadahoncho, Shizuokashi, Shizuoka, 422, Japan

[21] Appl. No.: 88,552

[22] Filed: Jul. 9, 1993

[30] Foreign Application Priority Data

Feb. 9, 1993 [JP] Japan ..... 5-044632

[51] Int. Cl.[5] ..... F23D 11/36

[52] U.S. Cl. ..... 431/153; 431/276

[58] Field of Search ..... 431/153, 276, 277

[56] References Cited

U.S. PATENT DOCUMENTS 5,165,885 11/1992 Iwahori ..... 431/153

5,205,729 4/1993 Iwahori ..... 431/153

*Primary Examiner*—Carroll B. Dority

*Attorney, Agent, or Firm*—Sughrue, Mion, Zinn, Macpeak & Seas

[57] ABSTRACT

When a lighter of the present invention is not in use, push-down means is kept positioned on one end side of lift-up means and has a lower end abutting against a lighter body to set a locked state to restrict a push-down action. As the push-down means is moved along the lift-up means toward the other end thereof, the locked state is released and the position of that movement of the push-down means toward the other end of the lift-up means is maintained by its relationship with respect to the lighter body or the lift-up means. When the push-down means is then pushed down, the lift-up means is rotated to open the valve means and ignition means is activated at a same time to ignite the fuel injected through the valve means. When that downward action of the push-down means is released, the push-down means moves upward to the original state while moving toward the one end of the lift-up means returning by the urging force of an elastic member along the lift-up means. Therefore, releasing of the locked state and ignition can both be accomplished merely by manipulating a single operating member, namely, the push-down means, and after the ignition, the push-down means automatically returns to the locked state. It is therefore possible to significantly improve the operability of the lighter without deteriorating the safety function of its safety device.

11 Claims, 18 Drawing Sheets

LIGHTER

BACKGROUND OF THE INVENTION

1. Field of the Invention

The present invention relates to a lighter for lighting cigarettes or like, for example, and, more particularly, to an improvement of a lighter which is equipped with a safety device to prevent small children from carelessly or accidentally igniting the lighter.

2. Description of the Related Art

Lighters for lighting cigarettes or the like are equipped with a so-called safety device. This measure is taken to prevent small children from easily igniting the lighter even through careless or accidental manipulation. Japanese Examined Patent Publication No. hei 3-501050 (U.S. Pat. No. 5,002,482) discloses a lighter equipped with such a safety device. This lighter has a safety latch member attached under a push-down member, which is manipulated at the time of ignition, in such a way that the pressing action of the push-down member is selectively permitted by rotating this safety latch member in the proper direction. As the pressing action of the push-down member is restricted by the safety latch member, therefore, a small child cannot easily ignite the lighter even the child tries to do so. Another conventional lighter is disclosed in Japanese Unexamined Patent Publication No. hei 4-363515.

The conventional structure has the following shortcoming. The safety device of the above-described lighter is a manipulator provided separately from the push-down member that is manipulated to ignite the lighter in such a way that the separate manipulator should be manipulated to unlock the push-down member before manipulating the push-down member for ignition. In other words, once the lighter is locked, two different operating members must be operated separately to ignite the lighter. This demands the user of a troublesome manipulation, thus lowering the operability of the lighter.

SUMMARY OF THE INVENTION

It is therefore an objective of the present invention to provide a lighter equipped with a safety device which can ensure sufficient safety without reducing the operability in actual use of the lighter.

To achieve the foregoing object, the lighter of the present invention comprises a lighter body for storing fuel; valve means, attached to an upper portion of the lighter body, for stopping injection of the fuel when closed and permitting injection of the fuel when open; ignition means, provided at the upper portion of the lighter body and activatable as needed to ignite the fuel injected by opening of the valve means; lift-up means, arranged rotatable via a rotary shaft at the upper portion of the lighter body and having one end connected to the valve means, for closing the valve means when urged in one direction by an elastic member and opening the valve means when rotated in the opposite direction against urging force of the elastic member; and push-down means, provided movable along the lift-up means on the other end side thereof, a slide position of the push-down means being properly maintained by a relationship with respect to the lighter body or the lift-up means, whereby when the lighter is not in use, the push-down means is kept positioned on the other end side of the lift-up means and has a lower end abutting against the lighter body to set a locked state to restrict a push-down action, as the push-down means is moved along the lift-up means toward the one end thereof, the locked state is released and a position of that movement of the push-down means toward the one end of the lift-up means is maintained by the relationship with respect to the lighter body or the lift-up means, when the push-down means is then pushed down, the lift-up means is rotated to open the valve means and the ignition means is activated at a same time to ignite the fuel injected through the valve means, and when that downward action of the push-down means is released, the push-down means moves upward to an original state while moving toward the other end of the lift-up means returning by the urging force of the elastic member along the lift-up means.

When the lighter is not in use, the safety device is working to lock the lighter. More specifically, in the locked state, the push-down means is kept positioned on the other end side of the lift-up means and its lower end abuts against the lighter body to restrict the downward action. In other words, even when a small child tries to push down the push-down means carelessly, the lower end of the push-down means abuts against the lighter body to restrict the downward action, thereby preventing careless ignition of the light. To unlock the lighter to use it, first, the push-down means is moved along the lift-up means toward one end thereof to release the locked state. Then, the push-down means is pushed down to rotate the lift-up means to open the valve means, and at the same time, the ignition means is activated to ignite the fuel injected through the valve means. Accordingly, the user can now light a cigarette or the like. To automatically return the lighter in the locked state after usage, the downward action of the push-down means is released, so that the push-down means can returns to the locked state as it moves toward the other end of the lift-up means, which is returning by the urging force of the elastic member, along the lift-up means.

According to the light of the present invention, therefore, releasing of the locked state and ignition can both be accomplished merely by manipulating a single operating member: the push-down means, and the lighter automatically returns to the locked state after ignition. The operability of the lighter can improved significantly without deteriorating the safety function of the safety device.

DETAILED DESCRIPTION OF THE PREFERRED EMBODIMENTS

Figure 1:
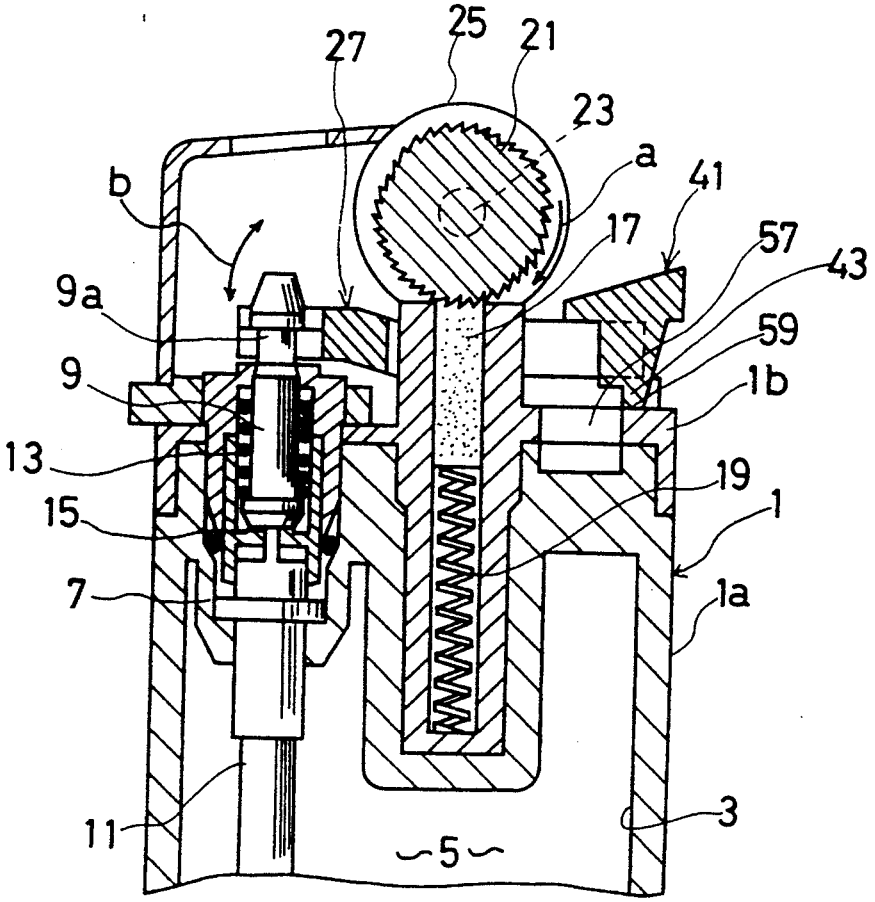
FIG. 1 is a partly cross-sectional view illustrating a lighter according to a first embodiment of the present invention not in use (locked state)

A first embodiment of the present invention will now be described referring to FIGS. 1 through 16. A lighter body 1 comprises a hollow case 1*a* and a lid 1*b* attached to the top edge of this case 1*a*. Formed in the case 1*a* of the lighter body 1 is a fuel tank 3 which retains fuel 5. A nozzle attachment 7 is formed on the left-hand side of the lighter body 1 in FIG. 1. A nozzle 9 is attached to this nozzle attachment 7. A fuel supply tube 11 is provided under the nozzle attachment 7, with its lower end extending to the bottom of the fuel tank 3. The nozzle 9 is seated on a seat portion 15 formed on the nozzle attachment 7, by a coil spring 13. The nozzle 9 and the seat portion 15 constitute valve means. With the nozzle 9 seated on the seal portion 15, no gas (vaporized fuel 5) will be injected. When the nozzle 9 is moved upward in the diagram against the force of the coil spring 13, the seat portion 15 is open and gas is injected upward in the diagram through the nozzle 9.

A flint 17 is disposed at the upper portion of the lighter body 1 on the right-hand side in the diagrams while being urged upward by a coil spring 19. Located above the flint 17 is a rotary file 21 on both sides of which auxiliary wheels 25 are disposed rotatable via a support shaft 23. As the rotary file 21 is rotated in the direction of an arrow a through the auxiliary wheels 25, it grinds the flint 17 to make sparks to thereby ignite the gas injected from the nozzle 9. The flint 17, rotary file 21 and auxiliary wheels 25 constitute ignition means.

Figure 15:
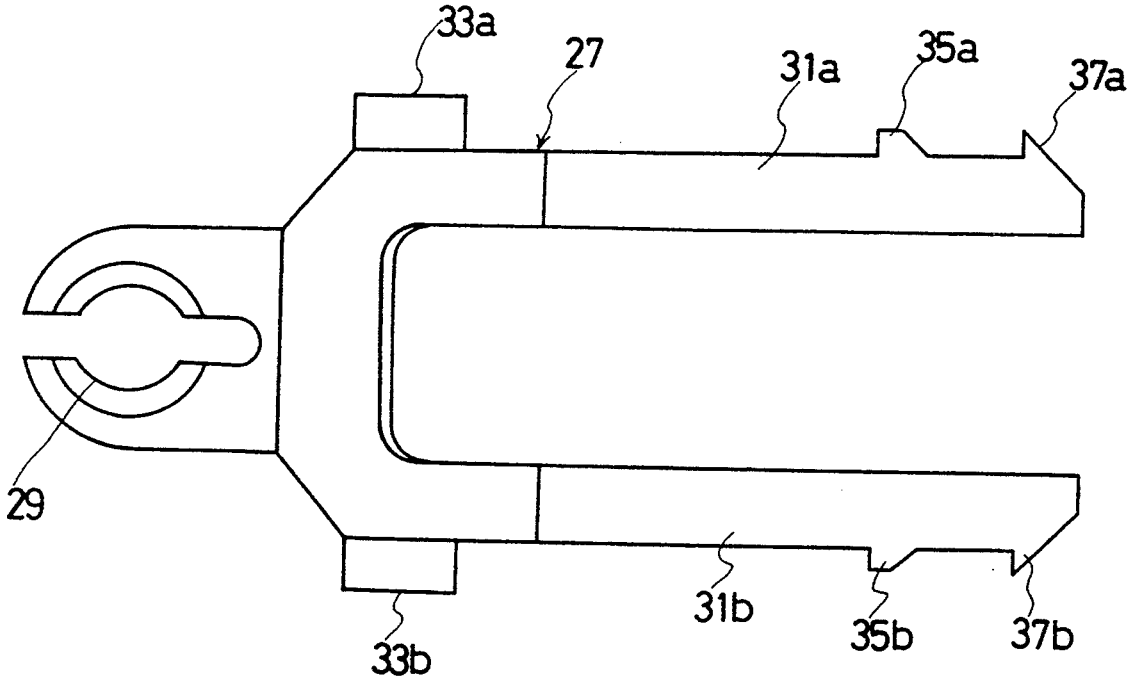
FIG. 15 is a plan view of the lift-up lever of the first embodiment.
Figure 16:
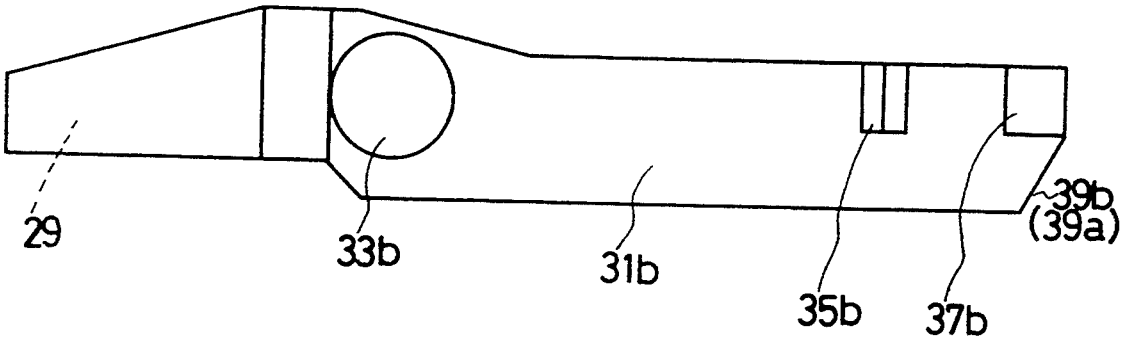
FIG. 16 is a side view of the lift-up lever of the first embodiment.

A lift-up lever 27 as lift-up means is disposed at the upper portion of the lighter body 1 in such a way as to be rotatable in the direction of an arrow b. This lift-up lever 27 is structured as shown in FIGS. 15 and 16. Provided at the nozzle-side end (left-hand end in the diagrams) of the lift-up lever 27 is a nozzle engage portion 29 which engages with a neck 9*a* of the nozzle 9 from below. The lift-up lever 27 has a pair of extending rail arms 31*a* and 31*b* on the right-hand side (in the diagrams) of the nozzle engage portion 29. Rotary shafts 33*a* and 33*b* are protrusively provided at the proximal end portions of both rail arms 31*a* and 31*b*, respectively. The lift-up lever 27 is supported rotatable on the lid 1*b* of the lighter body 1 via those rotary shafts 33*a* and 33*b*. The rail arm 31*a* has an engage pawl 35*a* formed thereon as a first projection and another engage pawl 37*a* formed closer to the distal end as a second engage pawl. Likewise, the rail arm 31*b* has engage pawls 35*b* and 37*b* formed thereon. The rail arms 31*a* and 31*b* respectively have inclined surfaces 39*a* and 39*b* each formed at the distal end and at the bottom.

Figure 9:
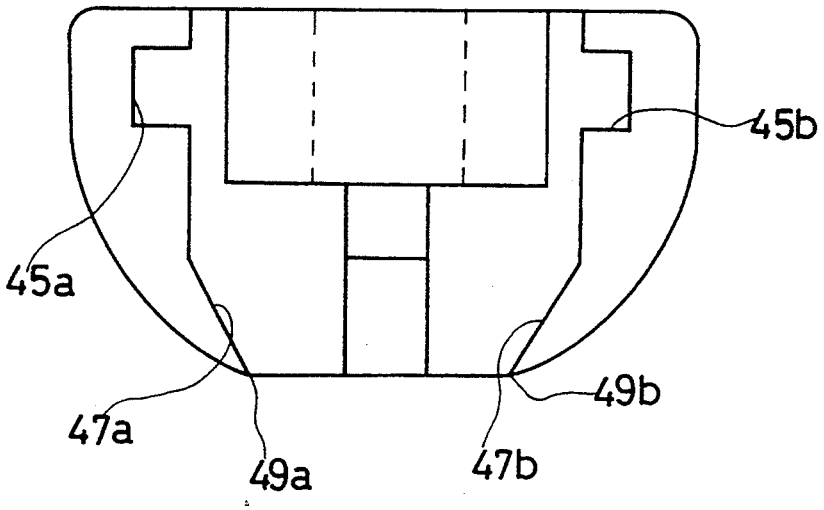
FIG. 9 is a bottom view of the push-down member of the first embodiment.
Figure 10:
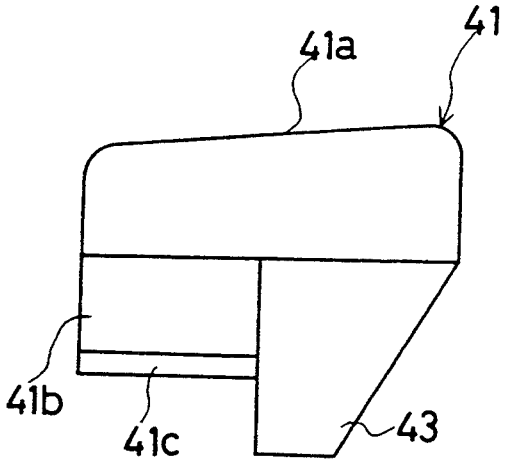
FIG. 10 is a side view of the push-down member of the first embodiment.
Figure 11:
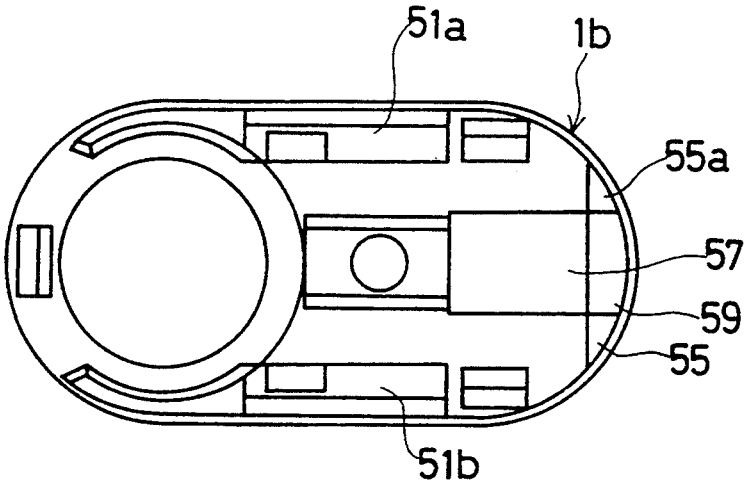
FIG. 11 is a plan view of the lid of a lighter body of the first embodiment.
Figure 12:
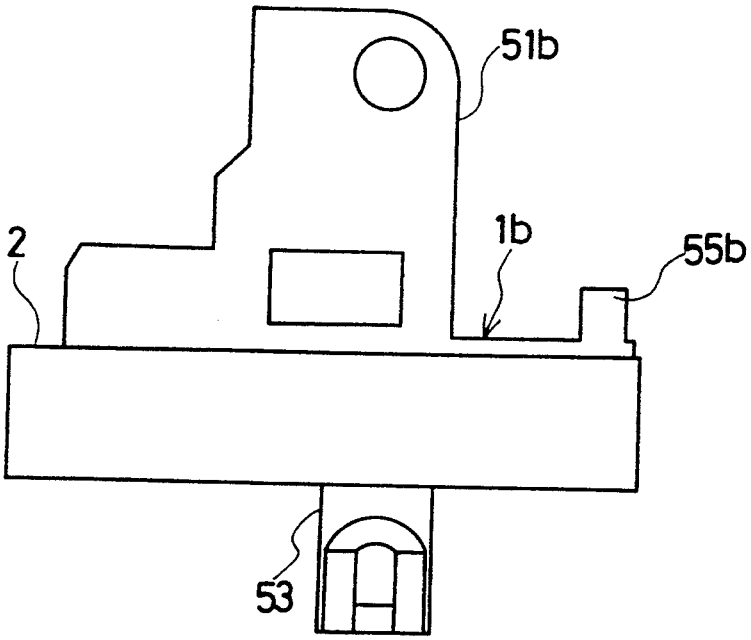
FIG. 12 is a side view of the lid of the lighter body of the first embodiment.
Figure 13:
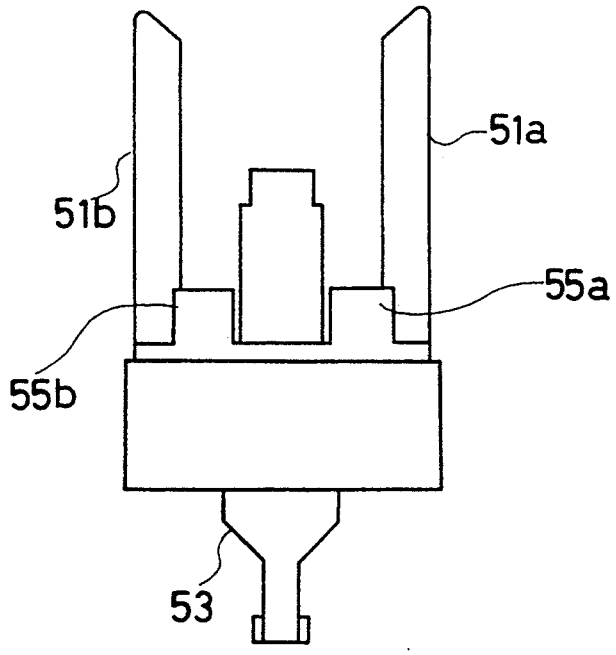
FIG. 13 is a rear view of the lid of the lighter body of the first embodiment.
Figure 14:
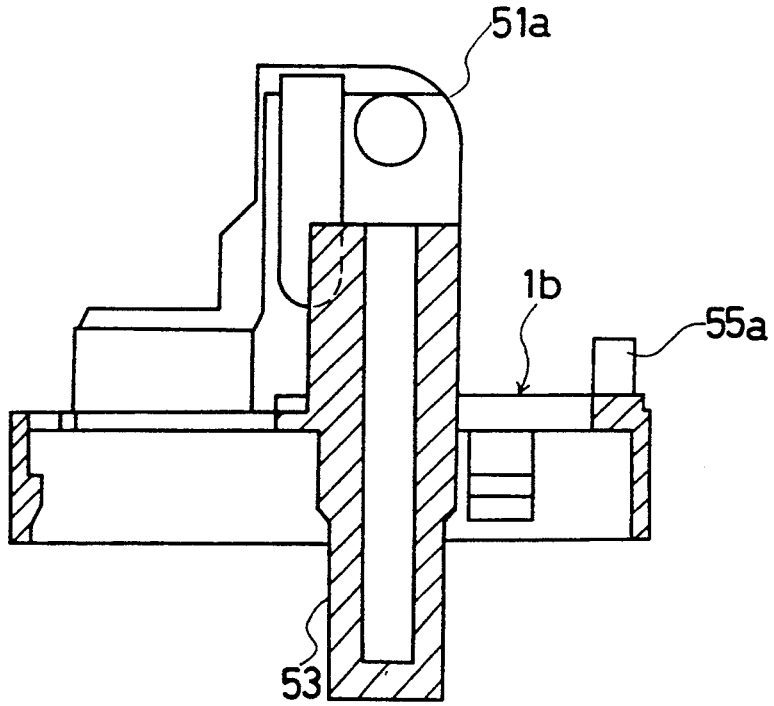
FIG. 14 is a cross section of the lid of the lighter body of the first embodiment.

As shown in FIG. 1, a push-down member 41 as push-down means is separately and movably attached to the top of the rail arms 31*a* and 31*b* on the right-hand side thereof in the diagram. The push-down member 41 has a structure as shown in FIGS. 7 through 10. The push-down member 41 has an operating portion 41*a* which is to be operated by a thumb of a user and a projection 41*b* protruding from the bottom of the operating portion 41*a*. (While this operating portion 41*a* is normally operated by the user's thumb, it may of course be operated by a different finger.) A flange 41*c* is formed at the bottom of the projection 41*b*. As shown in FIG. 10, a projection 43 is protrusive provided at the back of the flange 41*c*. This projection 43 has an slanted surface inclining toward the nozzle 9 as shown in FIG. 10. The push-down member 41 further has a pair of engage recesses 45*a* and 45*b* as a first engage portion and inclined surfaces 47*a* and 47*b* at the bottom side on the left and right sides, as shown in FIG. 9. The push-down member 41 also has engage portions 49*a* and 49*b* provided at the distal end as second engage portions.

The structure of the lid 1*b* of the lighter body 1, which has already been explained above, will be described with reference to FIGS. 11 through 14. The lid 1*b* has a pair of file stays 51*a* and 51*b* between which the aforementioned rotary file 21 and auxiliary wheels 25 are supported rotatably. Provided in the center portion of the lid 1*b* is a retainer 53 for retaining the flint 17 and coil spring 19. A pair of restoring projections 55*a* and 55*b* as restoring means are protrusively provided on the right-hand end portion (in the diagrams) of the lid 1*b*. Space 57 is formed on the left-hand side of those projections 55*a* and 55*b* in the diagrams, with a stopper portion 59 formed on the right-hand side (in the diagrams) in the space 57.

Figure 4:
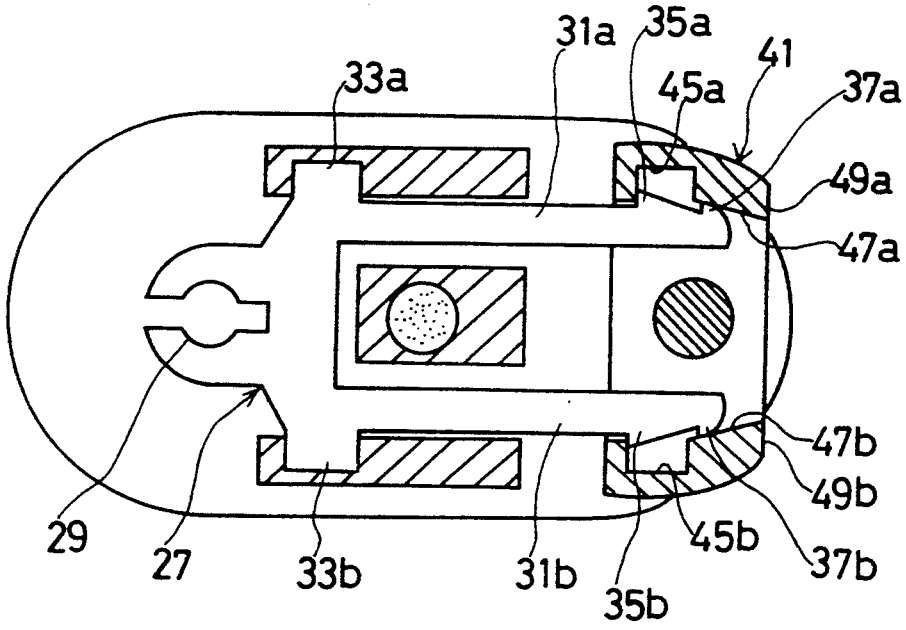
FIG. 4 is a plan view of the first embodiment, showing the relationship between the push-down member and a lift-up lever when the lighter is not in use (locked state)

The action of the lighter with the above-described structure will be described below. To begin with, a description will be given of the lighter not in use. In this case, the lighter is in the state shown in FIGS. 1 and 4. In this state, the nozzle 9 is pressed against the seat portion 15 by the force of the coil spring 13 so that the seat portion 15 is closed. The push-up lever 27 is urged in the counterclockwise direction in FIG. 1 and is staying nearly horizontal. The pressing member 41 is shifted rightward in FIG. 1, with the projection 43 abutting on the stopper portion 59 of the lid 1*b*. In other words, even if the pressing member 41 is pressed down through its operating portion 41*a*, the projection 43 hits against the stopper portion 59 to prevent the pressing member 41 from being pushed further downward (locked state). This means that the safety device is working. The relationship between the pressing member 41 and push-up lever 27 at that time is illustrated in FIG. 4. That is, the engage pawls 35*a* and 35*b* of the rail arm 31*a* and 31*b* are in engagement with the engage recesses 45*a* and 45*b* of the pressing member 41. This engagement restricts further movement of the pressing member 41 and prevents the member 41 from disengaging from the push-up lever 27.

Figure 2:
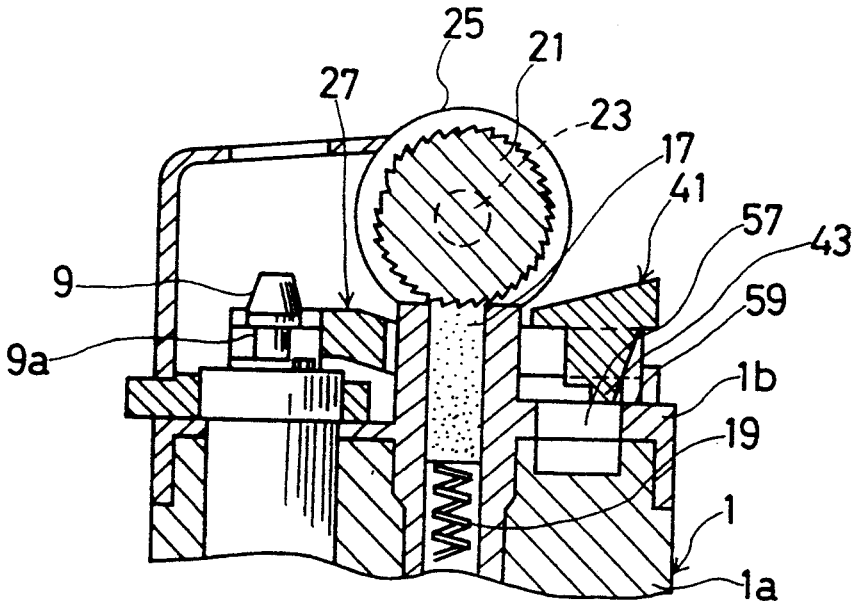
FIG. 2 is a partly cross-sectional view illustrating the lighter according to the first embodiment which is unlocked for usage by sliding a push-down member in the nozzle direction.
Figure 3:
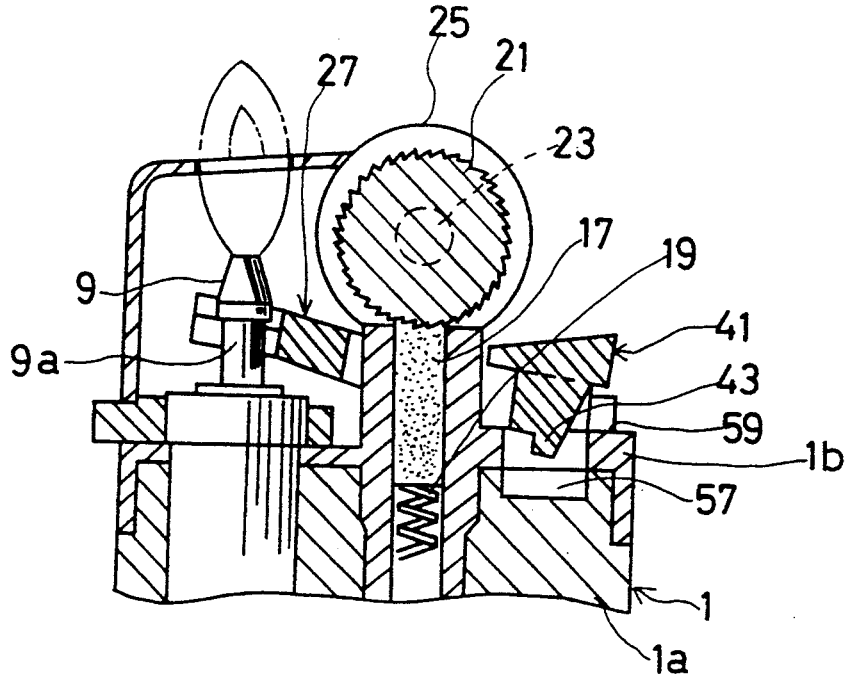
FIG. 3 is a partly cross-sectional view of the lighter according to the first embodiment, illustrating that a file is rotated and the push-down member is pushed down for ignition.
Figure 5:
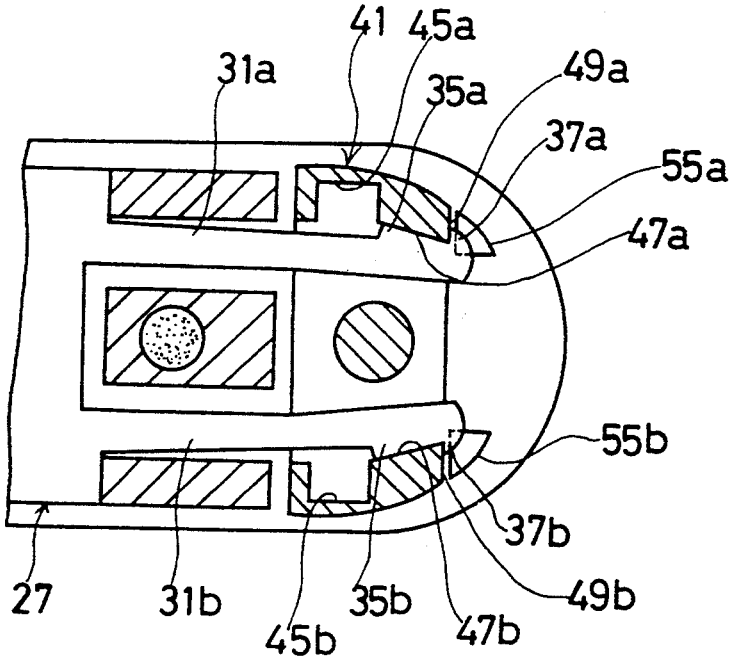
FIG. 5 is a plan view of the first embodiment, showing the relationship between the push-down member and the lift-up lever when the push-down member is slid in the nozzle direction to unlock the lighter for usage.
Figure 6:
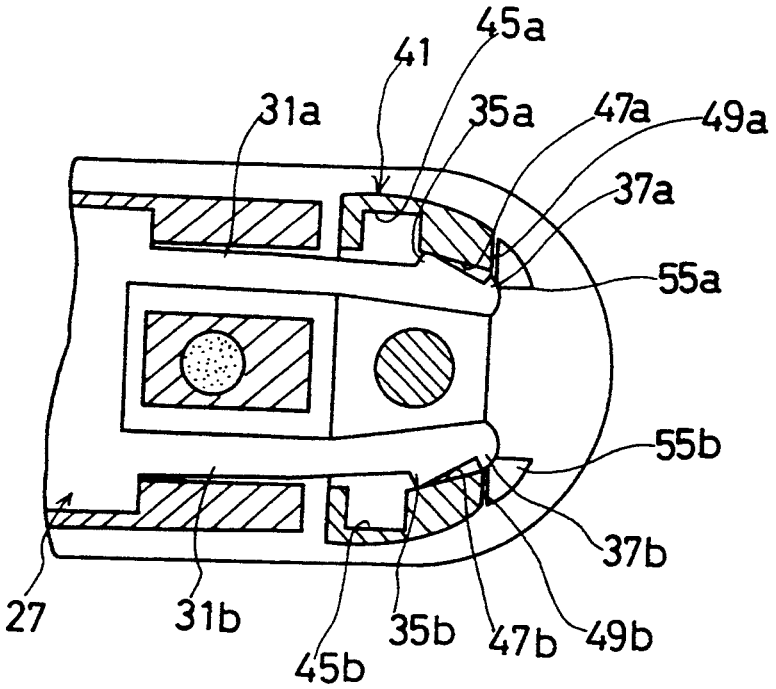
FIG. 6 is a plan view of the first embodiment, showing the relationship between the push-down member and the lift-up lever when the file is rotated and the push-down member is pushed down for ignition.
Figure 7:
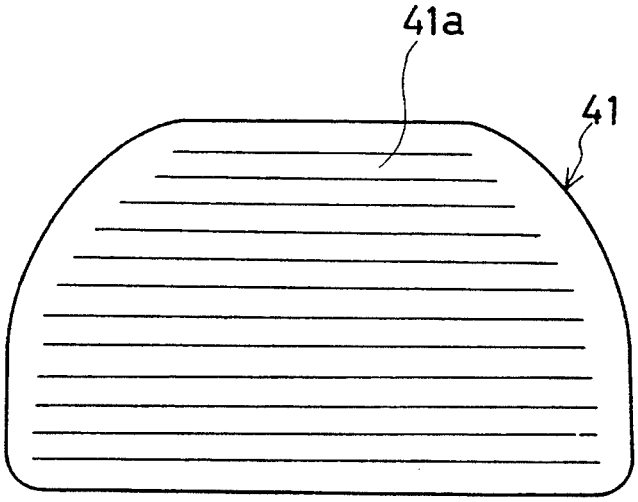
FIG. 7 is a plan view of the push-down member of the first embodiment.
Figure 8:
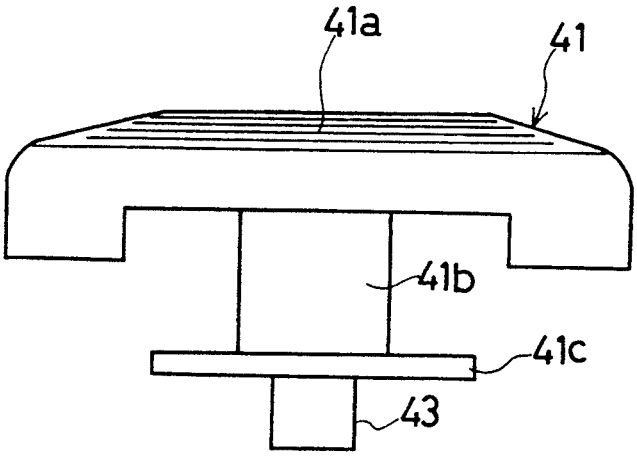
FIG. 8 is a front view of the push-down member of the first embodiment.

A description will now be given of how to ignite the fuel when the lighter is in the locked state. First, the pressing member 41 in the state shown in FIG. 1 is slid leftward in this diagram. At this time, the inclined surfaces 47*a* and 46*b* of the pressing member 41 cause the rail arms 31*a* and 31*b* to bend inward to permit the push-down member 41 to slide in the same direction. When the push-down member 41 slides by a predetermined amount, the engage pawls 37*a* and 37*b* of the rail arms 31*a* and 31*b* move over the engage portions 49*a* and 49*b* of the push-down member 41 and engage therewith, as shown in FIG. 5. Consequently, the push-down member 41 is held at the slid position, and the projection 43 is disengaged from the stopper portion 59 of the lid 1*b* to come above the space 57, as shown in FIG. 2. That is, the locked state is released and that unlocked state is maintained.

Then, the auxiliary wheels 25 and the rotary file 21 are rotated, and the push-down member 41 is pushed down at the same time. The downward action of the push-down member 41 rotates the lift-up lever 27 to the state shown in FIG. 3, so that the nozzle 9 rises against the force of the coil spring 13. As a result, gas is injected upward from the tip of the nozzle 9. At the same time, the rotation of the rotary file 21 grinds the flint 17 to make sparks so that the gas is ignited.

The downward movement of the push-down member 41 also pushes down the rail arm pair 31*a* and 31*b*. As the rail arms 31*a* and 31*b* respectively hit against the restoring projections 55*a* and 55*b* at that time, the rail arms 31*a* and 31*b* are bent inward. When the downward pressing of the push-down member 41 is released, the lift-up lever 27 tries to rotate back first by the urging force of the coil spring 13. At that time, the push-down member 41 tries to move along the rail arm pair 31*a* and 31*b* in the direction opposite to the nozzle 9. As the rail arms 31*a* and 31*b* are bent inward, the engage pawls 37*a* and 37*b* of those arms 31*a* and 31*b* will not engage with the engage portions 49*a* and 49*b* of the push-down member 41. Therefore, the push-down member 41 automatically returns to the state shown in FIG. 1. That is, the push-down member 41 returns to the initial locked state.

In short, this embodiment exhibits the following effects. First, releasing of the locked state and ignition can both be accomplished merely by manipulating a single operating member, namely, the push-down member 41. Therefore, this embodiment can significantly improve the operability of the lighter as compared with the conventional lighter, which requires one operating member to release the locked state and another operating member for ignition. This improvement will not deteriorate the safety function of the safety device, so that the lighter will not be ignited by careless or accidental manipulation by a small child or the like. In particular, since the lighter and the lighter automatically returns to the locked state after ignition and will not be left unlocked, thus securing sufficient safety.

Figure 23:
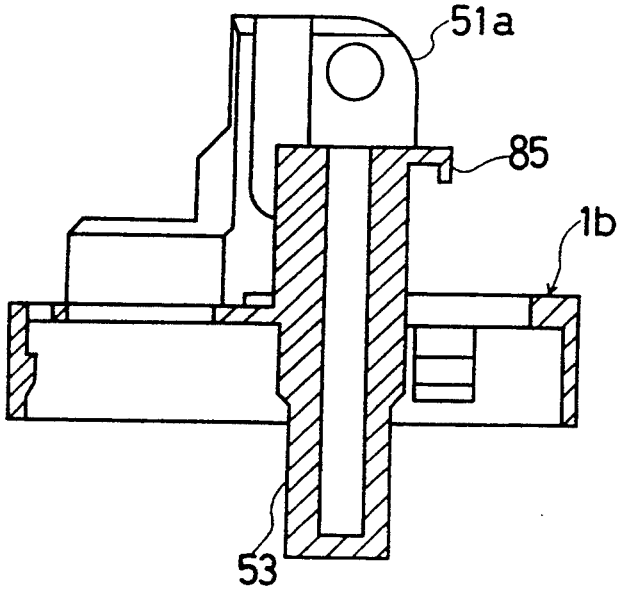
FIG. 23 is a cross section view of the lid of the lighter body of the second embodiment.
Figure 24:
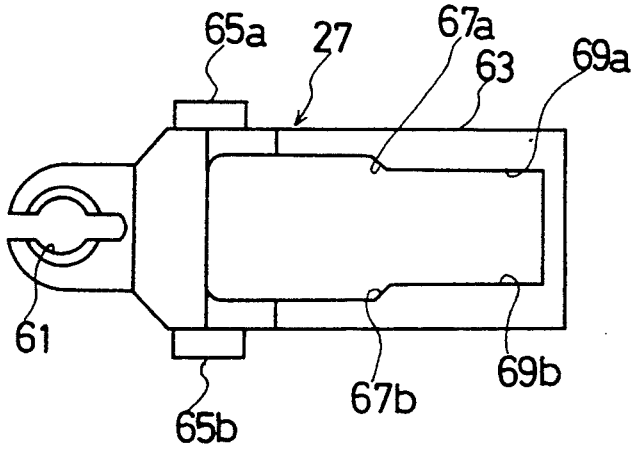
FIG. 24 is a plan view of the lift-up lever of the second embodiment.
Figure 25:
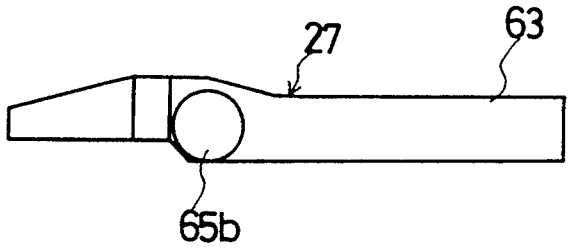
FIG. 25 is a side view of the lift-up lever of the second embodiment.
Figure 26:
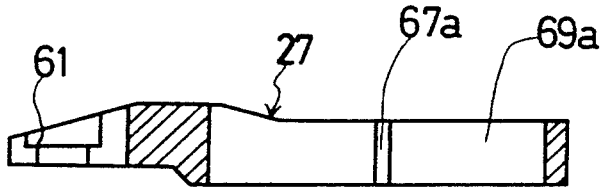
FIG. 26 is a cross-sectional view of the lift-up lever of the second embodiment.
Figure 27:
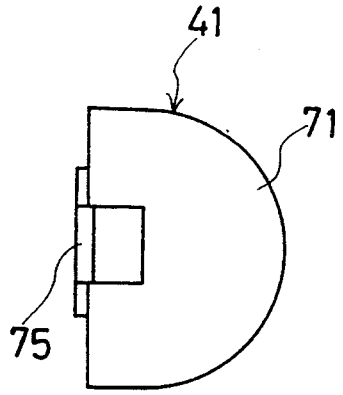
FIG. 27 is a plan view of the push-down member of the second embodiment.
Figure 28:
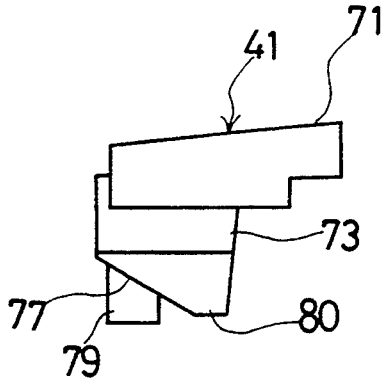
FIG. 28 is a side view of the push-down member of the second embodiment.
Figure 29:
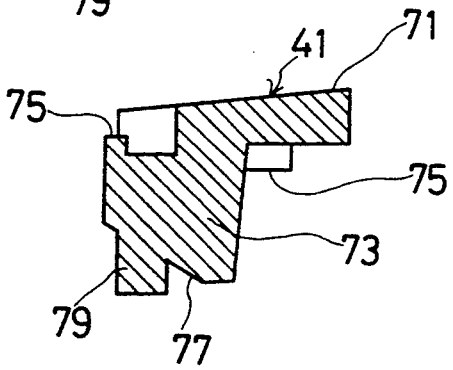
FIG. 29 is a cross-sectional view of the push-down member of the second embodiment.
Figure 30:
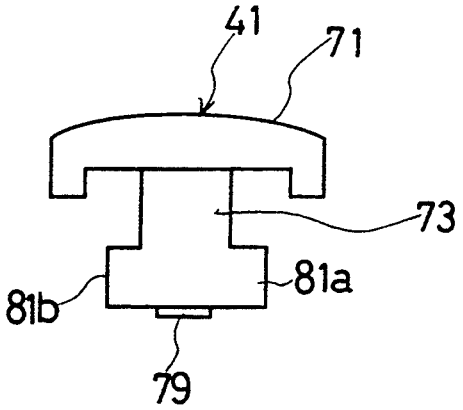
FIG. 30 is a rear view of the push-down member of the second embodiment.

A second embodiment will be described referring to FIGS. 17 through 33. Like or same reference numerals as used for components of the first embodiment will be given to corresponding or identical components of the second embodiment. The lift-up lever 27 as lift-up means in this embodiment has a structure as shown in FIGS. 24 through 26. Provided at the nozzle-side end (left-hand end in the diagrams) of the lift-up lever 27 is a nozzle engage portion 61 which engages with the neck 9*a* of the nozzle 9 from below. The lift-up lever 27 has a frame portion 63 formed on the right-hand of the nozzle engage portion 61 side in the diagrams. Rotary shafts 65*a* and 65*b* are protrusively provided at the proximal end portion of the frame portion 63. The lift-up lever 27 is supported rotatable on the lid 1*b* of the lighter body 1 via those rotary shafts 65*a* and 65*b*. Step portions 67*a* and 67*b* are formed in a widthwise middle portion of the frame portion 63 in the diagrams. Both inner side surfaces of the frame portion 63 located on the right-hand side of the step portions 67*a* and 67*b* in the diagrams serve as guide surfaces 69*a* and 60*b*, respectively.

Figure 17:
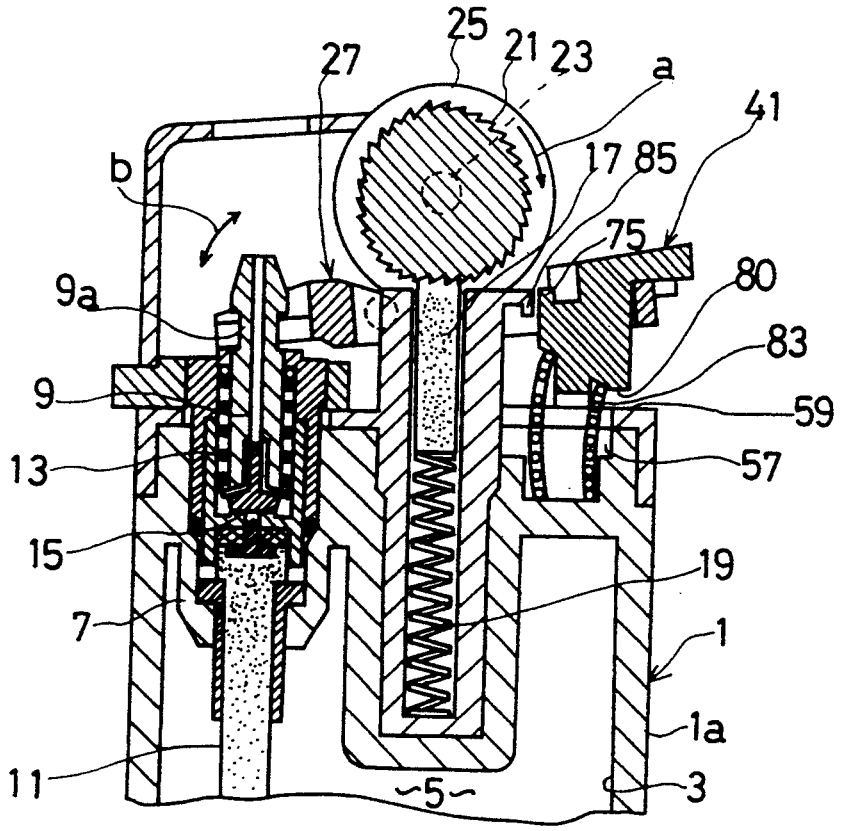
FIG. 17 is a partly cross-sectional view illustrating a lighter according to a second embodiment of the present invention not in use (locked state)

As shown in FIG. 17, the push-down member 41 as push-down means is separately and movably attached to the top of the frame portion 63 of the lift-up lever 27. This push-down member 41 has a structure as shown in FIGS. 27 through 30. The push-down member 41 has an operating portion 71 which is to be operated by a thumb of a user and a projection 73 protruding from the bottom of the operating portion 71. (While this operating portion 71 is normally operated by the user's thumb, it may of course be operated by a different finger.) An engage pawl 75 is formed in front of the operating portion 71. The projection 73 has an inclined surface 77 formed on the front side, with a projection 79 protruding from a nearly middle portion of the inclined surface 77. Guide members 81*a* and 81*b* are formed at the bottom of the projection 73 on the left- and right-hand sides thereof. The bottom of the projection 73 serves as a stop portion 80.

Figure 31:
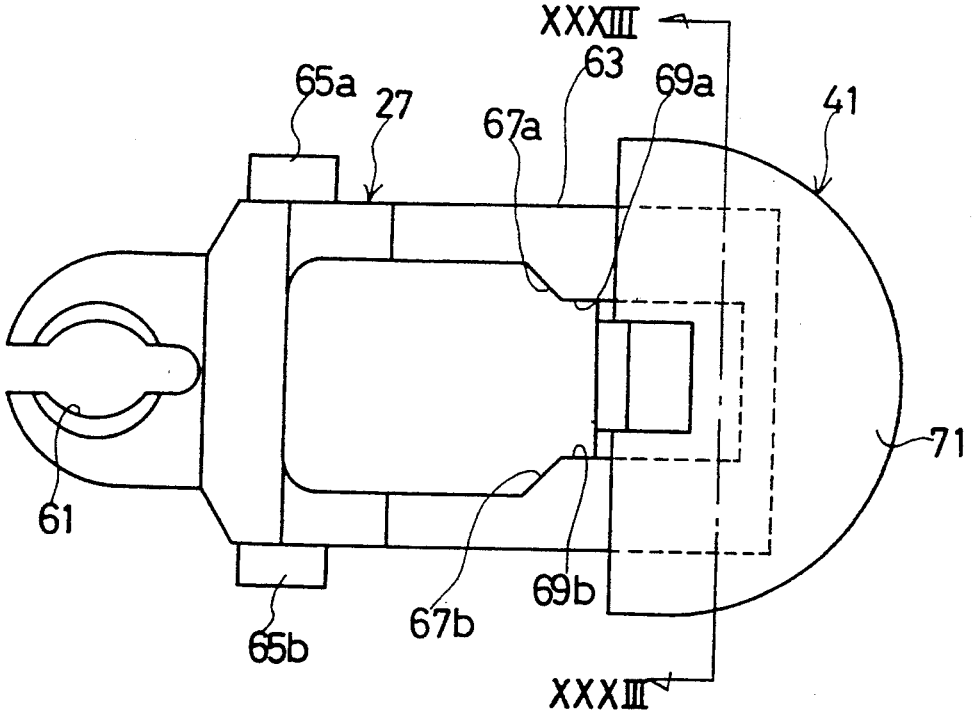
FIG. 31 is a plan view of the second embodiment, showing the push-down member attached to the lift-up lever.
Figure 32:
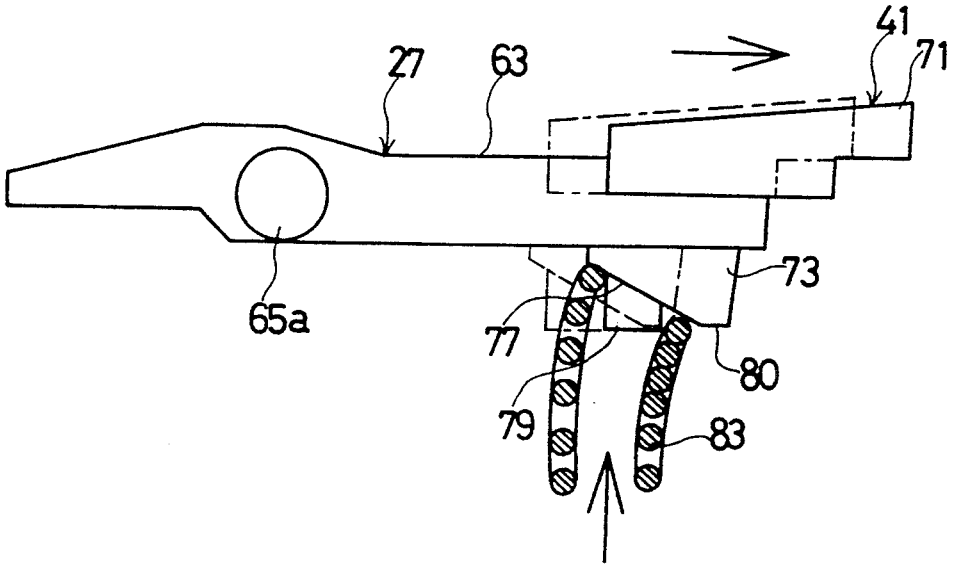
FIG. 32 is a side view of the second embodiment, showing the push-down member attached to the lift-up lever and its relationship with a coil spring.
Figure 33:
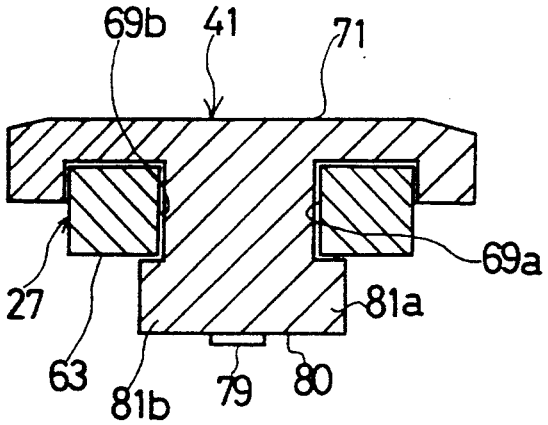
FIG. 33 is a cross section of the second embodiment taken along XXXIII—XXXIII in FIG. 31.

The push-down member 41 having the above-described structure are engaged with the inner side of the frame portion 63 of the lift-up lever 27 in the manner shown in FIGS. 31 through 33. More specifically, the push-down member 41 is inserted into the left portion of the frame portion 63 of the lift-up lever 27 from the above and is then slid rightward (see FIGS. 31 and 32) for attachment. Consequently, the guide members 81*a* and 81*b* of the push-down member 41 come into engagement with the bottom surfaces of the frame portion 63 at the bottoms of the guide surfaces 69*a* and 60*b*, thus preventing the push-down member 41 from coming off upward from the frame portion 63. The bottom surfaces of the left and right side portions of the operating portion 71 are in engagement with the top surfaces of the frame portion 63 at the tops of the guide surfaces 69*a* and 60*b*.

Figure 21:
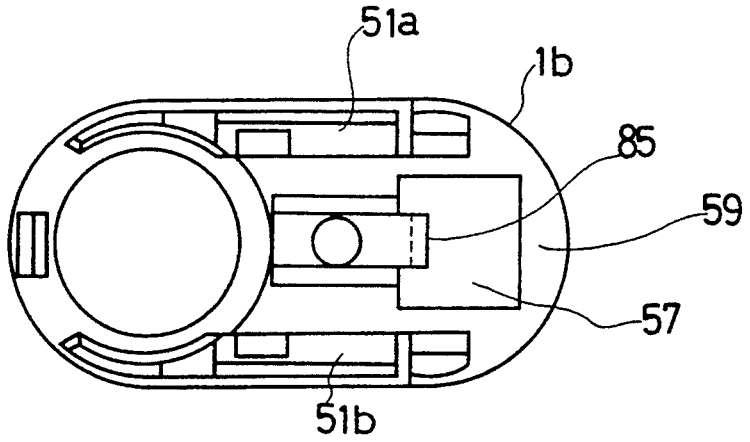
FIG. 21 is a plan view of the lid of a lighter body of the second embodiment.
Figure 22:
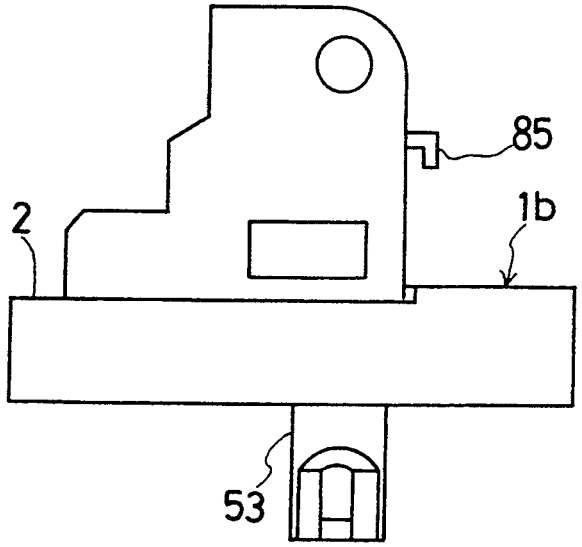
FIG. 22 is a side view of the lid of the lighter body of the second embodiment.

As shown in FIG. 17, a coil spring 83 as elastic means is disposed in the space 57 in such a manner that the projection 79 of the push-down member 41 is fitted in the upper end portion of the coil spring 83 whose top end is abutting on the inclined surface 77. In other words, the push-down member 41 is set to be always urged upward as well as rearward. The urging acts not only in the upward direction but also in the rearward direction because of the presence of the inclined surface 77. That is, when the force of the coil spring 83 acts on the inclined surface 77, this force urges the push-down member 41 rearward through the inclined surface 77 as well as in the upward direction. As shown in FIG. 21 through 23, an engage portion 85 is formed at the top and in the center portion of the lid 1*b*. The engage pawl 75 of the push-down member 41 is selectively engaged with this engage portion 85, and when the engagement is established, the unlocked state is maintained. The other structure of the lid 1*b* is the same as that of the first embodiment.

Figure 18:
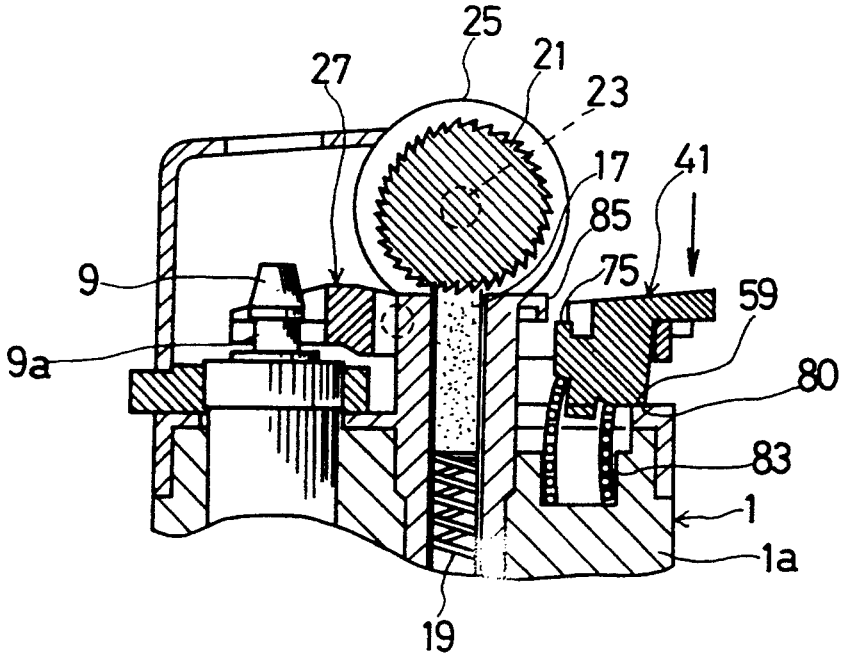
FIG. 18 is a partly cross-sectional view of the lighter according to the second embodiment, illustrating that further downward movement of a push-down member is restricted.

The action of the lighter having the above-described structure will now be described. To begin with, the action of the lighter when not in use will be described. In this case, the lighter is in the state as shown in FIG. 17; the right end (in the diagram) of the lift-up lever 27 is rotated slightly counterclockwise as compared with that of the first embodiment. Even when the push-down member 41 is pushed downward for ignition in this state, the stop portion 80 abuts on the stopper portion 59 of the lid 1*b* as shown in FIG. 18, thereby restricting the further downward movement of the push-down member 41. The restriction of the downward movement of the push-down member 41 thus restricts the clockwise rotation of the lift-up lever 27 in the diagram. That is, the lighter is locked so that even if a small child carelessly presses the push-down member 41 down, the lighter will never be ignited.

Figure 19:
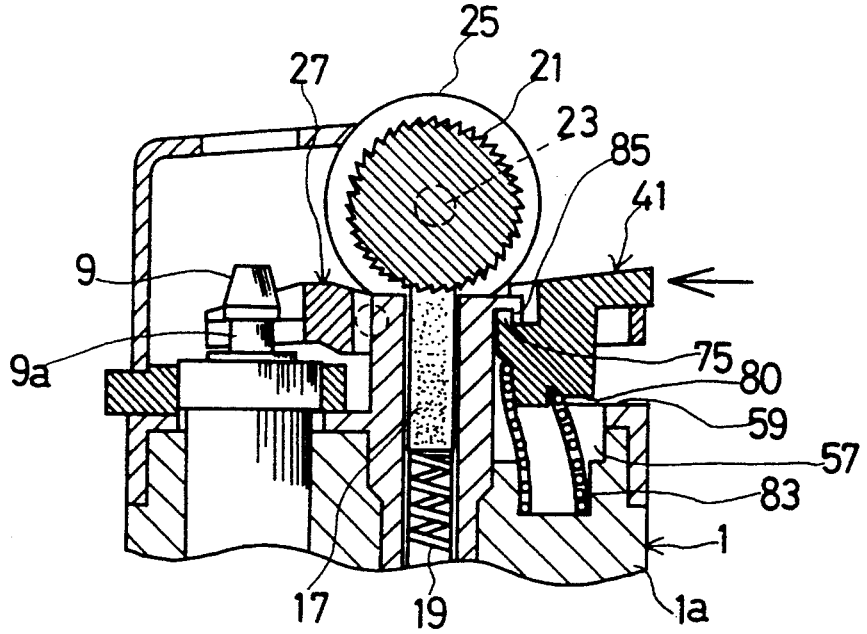
FIG. 19 is a partly cross-sectional view illustrating the lighter according to the second embodiment which is unlocked for usage by sliding a push-down member in the nozzle direction.

The action of the lighter when in use will be described below. In this case, the ignition operation starts with the unlocking of the lighter. The push-down member 41 is pressed down to the state shown in FIG. 18, and is then pushed forward (in the direction of the nozzle 9). Accordingly, the push-down member 41 slides in the direction of the nozzle 9 along the frame portion 63 of the lift-up lever 27. The engage pawl 75 of the push-down member 41 thus passes under the engage portion 85 of the lid 1*b* without any interference. When the pressure against the push-down member 41 is released in this state, the push-down member 41 comes to the state as shown in FIG. 19 where the engage pawl 75 of the push-down member 41 engages with the engage portion 85 of the lid 1*b* from below to keep the push-down member 41 at the slid position. In this state, the stop portion 80 of the push-down member 41 does not interfere with the stopper portion 59 of the lid 1*b*. That is, the locked state is released and the lighter is kept unlocked. Under the situation, the file 21 is rotated via the auxiliary wheels 25 and the push-down member 41 is moved further downward. As the stop portion 80 of the push-down member 41 has been slid to the position where it doe not abut on the stopper portion 59 of the lid 1*b*, the push-down member 41 moves further down. The downward motion of the push-down member 41 rotates the lift-up lever 27 clockwise in FIG. 20, lifting up the nozzle 9 to inject gas. The injected gas will be burned by sparks produced by the rotation contact of the file 21 with the flint 17.

Figure 20:
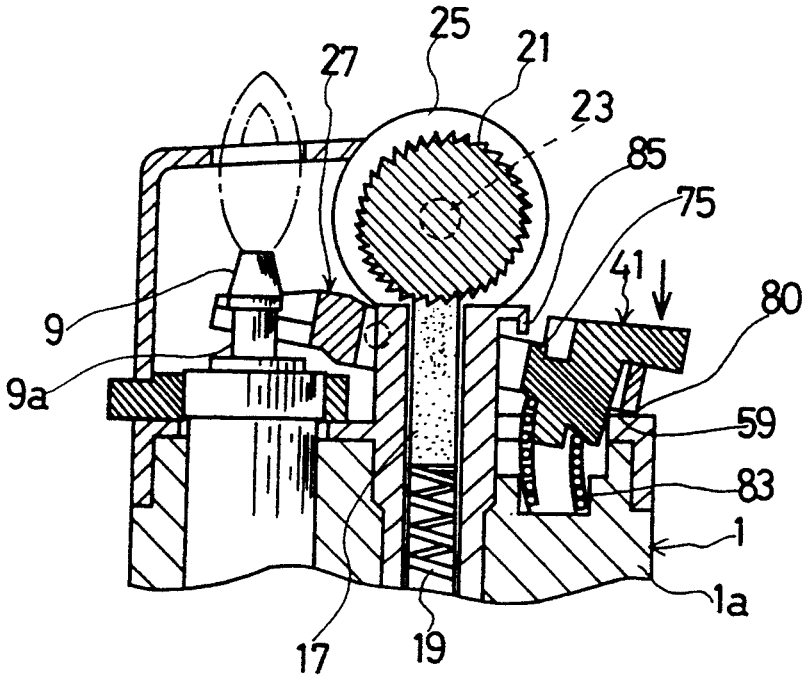
FIG. 20 is a partly cross-sectional view of the lighter according to the second embodiment, illustrating that a file is rotated and the push-down member is pushed down for ignition.

A description will now be given of how to extinguish the fire after usage. In the ignition state, i.e., with the push-down member 41 pushed downward, the lift-up lever 27 is tilted down rightward as shown in FIG. 20, so that the push-down member 41 is shifted rearward (rightward in the diagram). That is, the push-down member 41 is shifted to the position where its engage pawl 75 does not engage with the engage portion 85 of the lid 1*b*. When the pressure on the push-down member 41 in that state is released, the push-down member 41 moves upward by the force of the coil spring 83 and also slides rearward because the spring force acts rearward as well as upward. As a result, the push-down member 41 automatically returns to the state as shown in FIG. 17. The inclined surface 77 of the push-down member 41 effectively assists the urging action of the coil spring 83. More specifically, since the top end of the coil spring 83 abuts on the inclined surface 77 so that part of the spring force will act rearward, when the pressure on the push-down member 41 is released, the push-down member 41 surely slides rearward while moving upward to return to the initial position.

In short, this embodiment also produces the same effect as the first embodiment. That is, releasing of the locked state and ignition can both be accomplished merely by manipulating a single operating member, namely, the push-down member 41. Therefore, this embodiment can significantly improve the operability of the lighter by the user. This improvement will not deteriorate the safety function of the safety device, so that the lighter will not be ignited by careless or accidental manipulation by a small child or the like.

Figure 34:
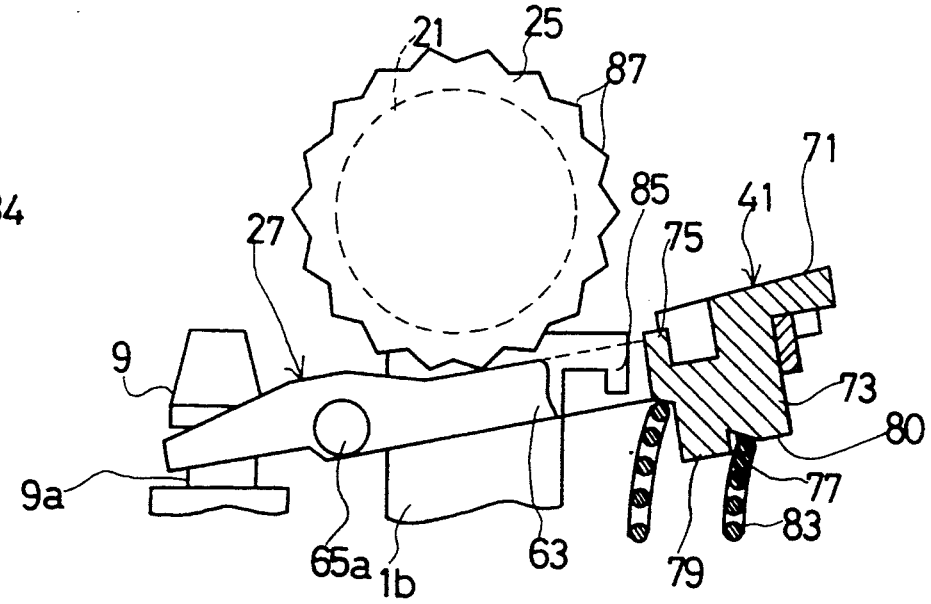
FIG. 34 is a side view of a third embodiment of the present invention not in use (locked state), showing the relationship between a lift-up lever and auxiliary wheels.
Figure 35:
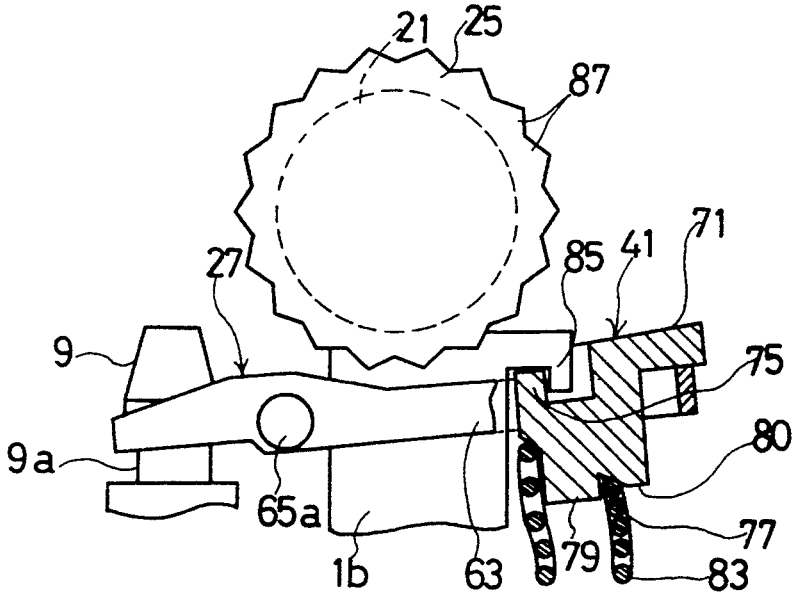
FIG. 35 is a side view of the third embodiment, showing the relationship between a lift-up lever and auxiliary wheels when in an unlocked state.

A third embodiment will be described below referring to FIGS. 34 and 35. In this embodiment, a plurality of projections 87 serving as a stopper are formed around the auxiliary wheels 25. When the lighter is not in use, the outer surfaces of the auxiliary wheels 25 are abutting on the top of the lift-up lever 27 so that the auxiliary wheels 25 and thus the file 21 will not rotate accidentally. To make this surer, the projections 87 are provided in this embodiment. When the push-down member 41 is pushed to slide forward to permit the engagement of the engage pawl 75 with the engage portion 85 for actual usage of the lighter, the projections 87 of the auxiliary wheels 25 are set apart from the top of the lift-up lever 27, as shown in FIG. 35. This permits the auxiliary wheels 25 and thus the file 21 to rotate.

Figure 36:
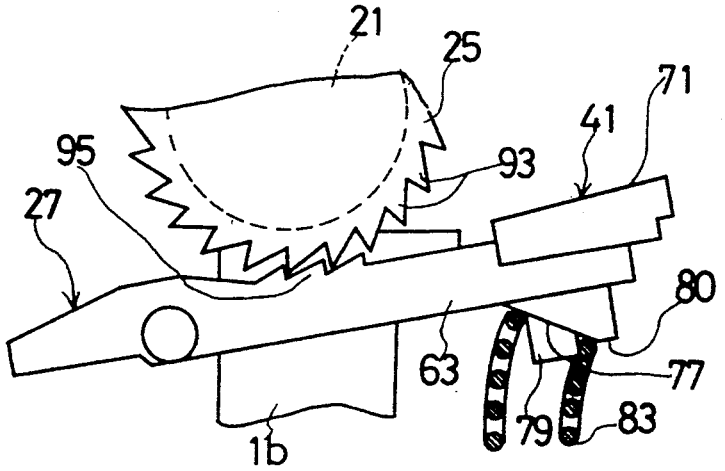
FIG. 36 is a side view of a fourth embodiment of the present invention not in use (locked state), showing the relationship between a lift-up lever and auxiliary wheels.

A fourth embodiment will be described below referring to FIG. 36. In this embodiment, the concept of the third embodiment is further expanded. Ratchets 93 are formed on the outer surfaces of the auxiliary wheels 25, and ratchets 95 are likewise formed on the top of the lift-up lever 27. When the lighter is not in use, the ratchets 93 of the auxiliary wheels 25 are in engagement with the ratchets 95 of the lift-up lever 27, thereby surely restricting accidental rotation of the auxiliary wheels 25 and thus the rotation of the file 21. When the push-down member 41 is pushed to slide forward to permit the engagement of the engage pawl 75 with the engage portion 85 for actual usage of the lighter, the ratchets 93 of the auxiliary wheels 25 are disengaged from the ratchets 95 of the lift-up lever 27. This permits the auxiliary wheels 25 and thus the file 21 to rotate. It is therefore possible to make the action and effect of the third embodiment surer.

Figure 37:
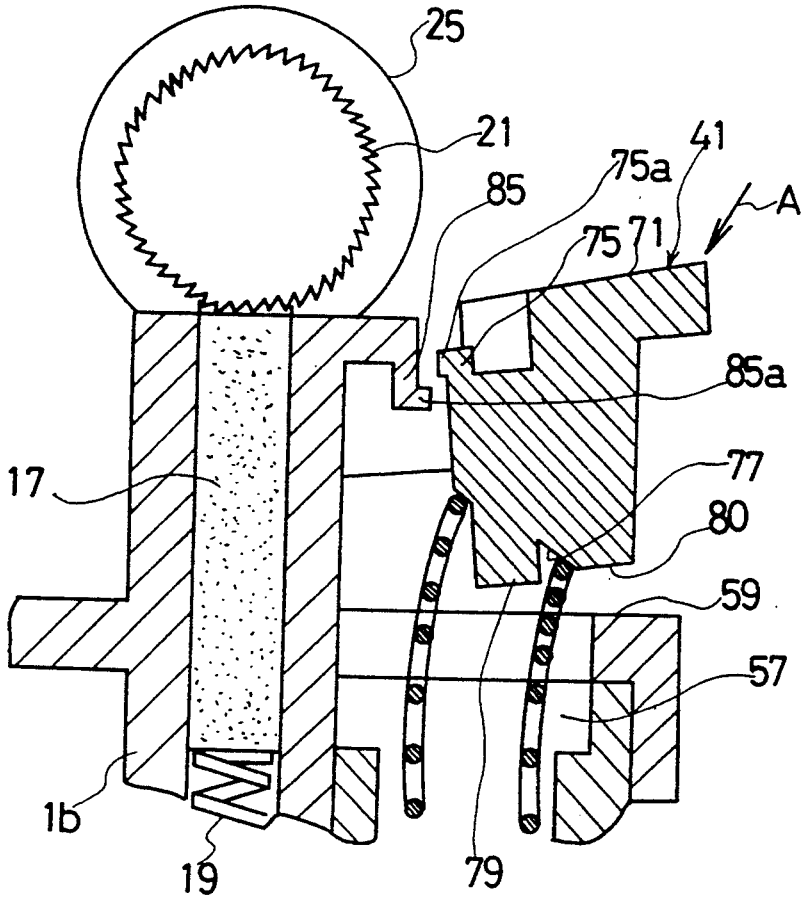
FIG. 37 is a cross-sectional view of a fifth embodiment of the present invention, showing the relationship between an engage portion and an engage pawl, which are provided to prevent an easy unlocking manipulation.

A fifth embodiment will be described below referring to FIG. 37. In this embodiment, a projection 75*a* is provided on the engage pawl 75 of the push-down member 41, while a projection 85*a* is provided on the engage portion 85 of the lid 1*b*. The reason for the provision of those projections 75*a* and 85*a* is as follows. As explained in the description of the second embodiment, to use the lighter, the push-down member 41 is pushed downward first, and is then slid forward to unlock the lighter. But, there is a possibility that this unlocking is accomplished spontaneously by pushing the push-down member 41 obliquely downward (in the direction of an arrow A in the diagram). This is not sufficient to prevent a small child from carelessly or accidentally ignite the lighter. The projections 75*a* and 85*a* are provided to prevent the unlocking of the lighter by the application of the obliquely-downward pressure on the push-down member 41. When the push-down member 41 is pushed obliquely downward, the projection 75*a* of the engage pawl 75 hits against the projection 85*a* of the engage portion 85 to restrict further movement of the push-down member 41, thus preventing the lighter from being unlocked. It is thus possible to surely prevent small children from accidentally ignite the lighter.

Figure 38:
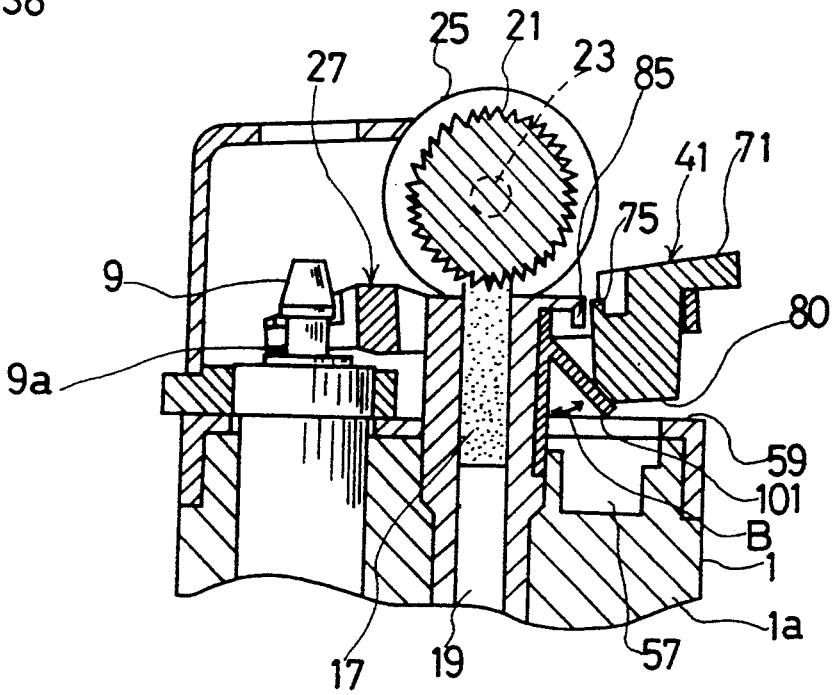
FIG. 38 is a cross-sectional view illustrating part of a lighter according to a sixth embodiment of the present invention.

A sixth embodiment will be described below referring to FIG. 38. In this embodiment, a leaf spring 101 is used for the coil spring 83. This leaf spring 101 bends in the direction of an arrow B in the diagram. The force of the leaf spring 101 returning to the original position from the bent state is also directed obliquely upward, and thus serves to set back the push-down member 41 rearward as well as upward. Accordingly, this structure can provide the same effect as the first embodiment.

Figure 39:
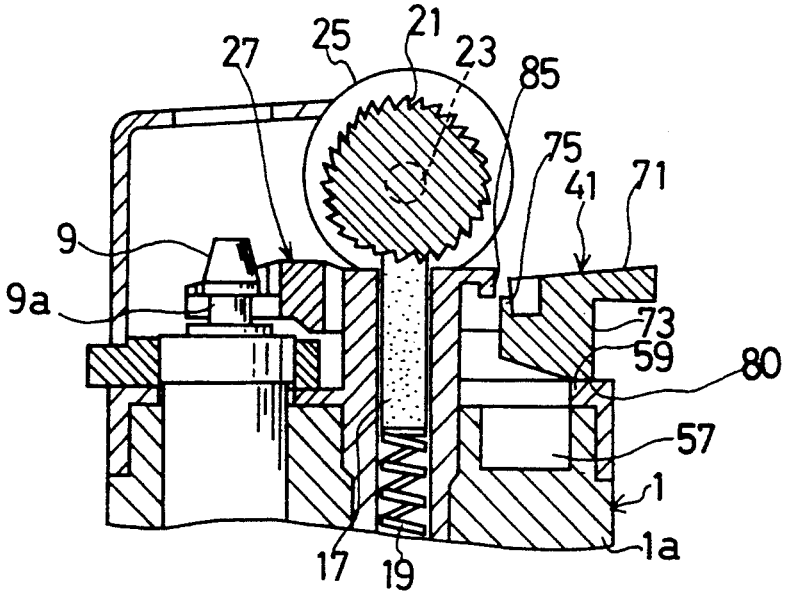
FIG. 39 is a partly cross-sectional view illustrating part of a lighter according to a seventh embodiment of the present invention in a locked state.
Figure 40:
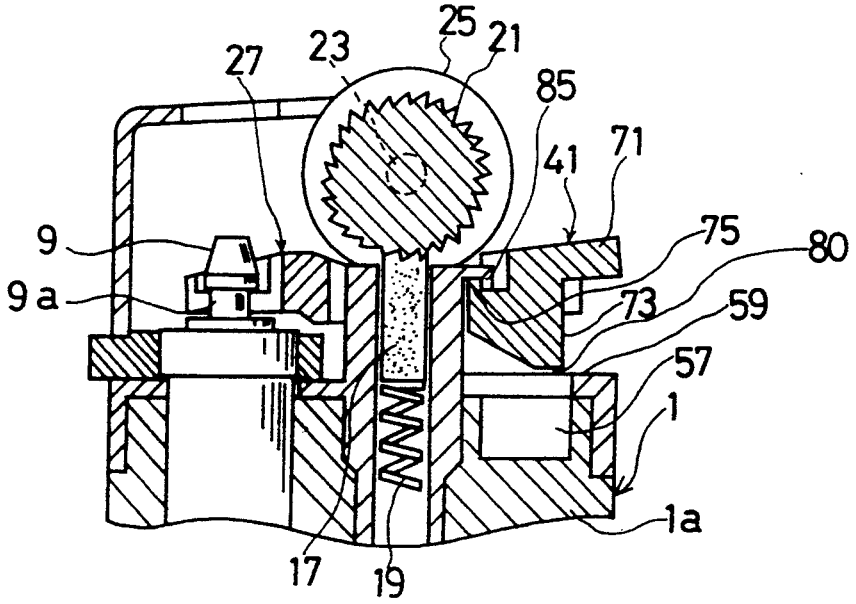
FIG. 40 is a partly cross-sectional view illustrating part of the lighter according to the seventh embodiment when unlocked.
Figure 41:
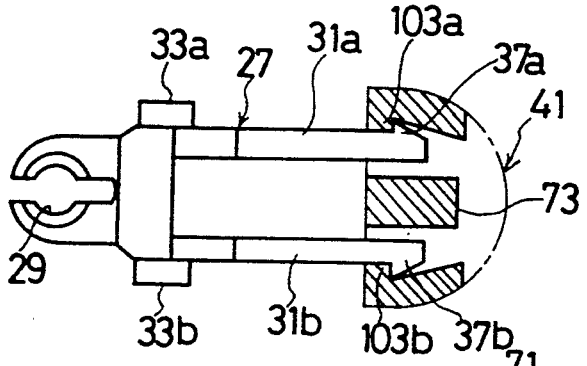
FIG. 41 is a plan view of the seventh embodiment, showing the relationship between a lift-up lever and a push-down member.
Figure 42:
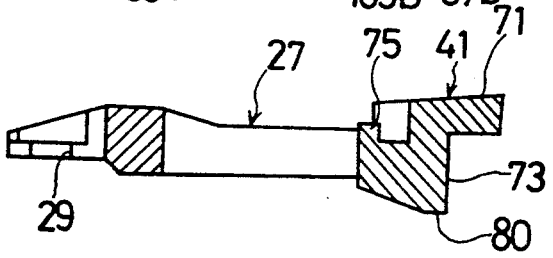
FIG. 42 is a cross-sectional view of the seventh embodiment, showing the relationship between the lift-up lever and the push-down member.
Figure 43:
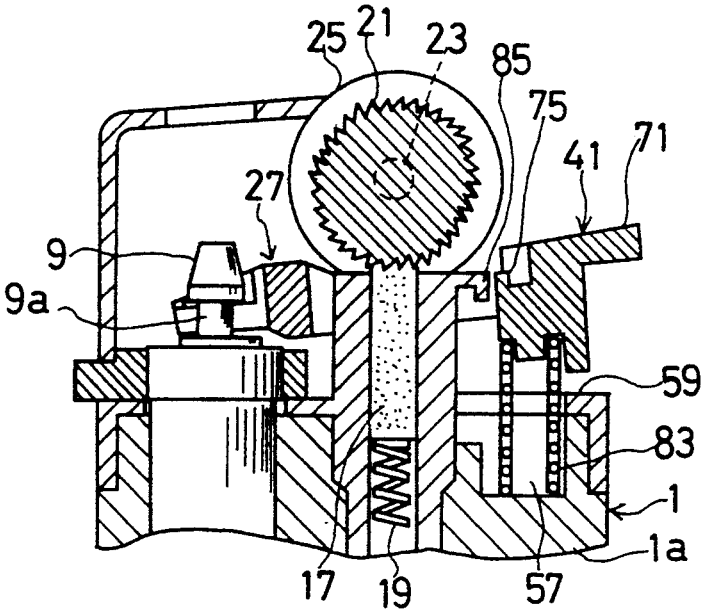
FIG. 43 is a partly cross-sectional view illustrating part of a lighter according to an eighth embodiment of the present invention in a locked state.
Figure 44:
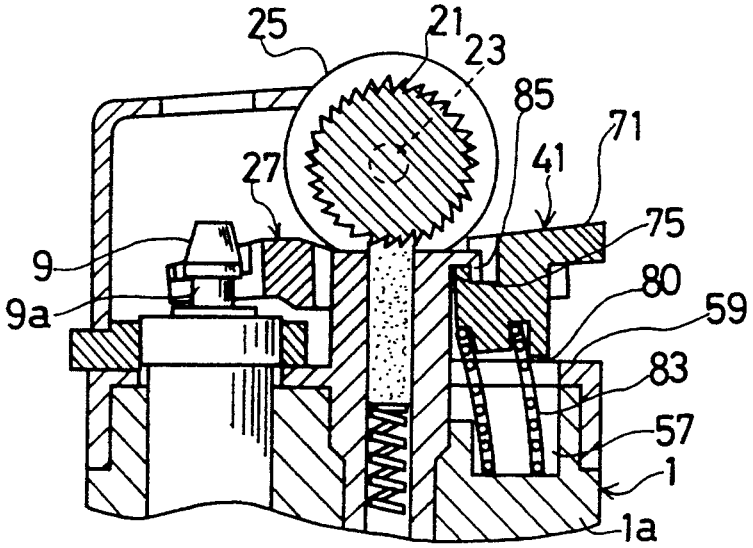
FIG. 44 is a partly cross-sectional view illustrating part of the lighter according to the eighth embodiment when unlocked.
Figure 45:
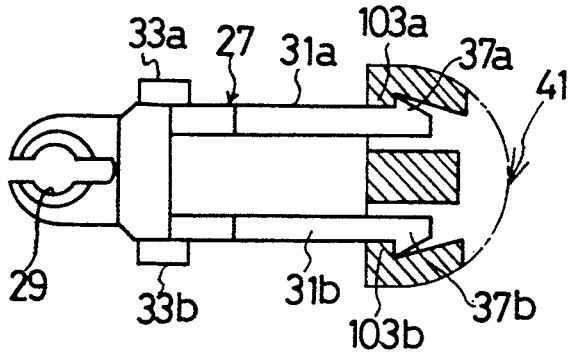
FIG. 45 is a plan view of the eighth embodiment, showing the relationship between a lift-up lever and a push-down member.
Figure 46:
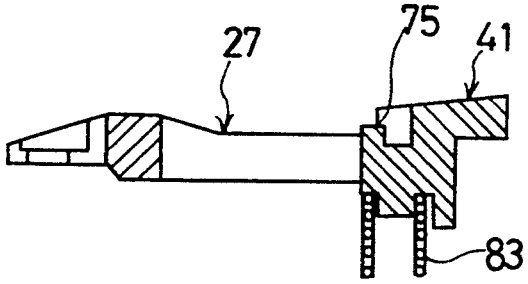
FIG. 46 is a cross-sectional view of the eighth embodiment, showing the relationship between the lift-up lever and the push-down member.

A seventh embodiment will be described below referring to FIGS. 39 through 42. In this embodiment, the first engage pawls 35*a* and 35*b* are omitted from the lift-up lever 27 in the first embodiment, as shown in FIG. 41. Instead, engage portions 103*a* and 103*b* are formed at the bottom and on the left and right sides of the operating portion 71 of the push-down member 41 in the second embodiment, so that those engage portions 103*a* and 103*b* engage with the second engage pawls 37*a* and 37*b* of the lift-up lever 27. When the lighter is not in use, it is locked, so that even when the push-down member 41 is pushed down, the stop portion 80 abuts on the stopper portion 59 of the lid 1*b* as shown in FIG. 39 to restrict further downward movement of the push-down member 41. The lighter will not therefore be ignited.

To use the lighter, the push-down member 41 is pushed down to the position shown in FIG. 39 and is then slid forward. In this case, the push-down member 41 is slid while the pair of rail arms 31*a* and 31*b* of the lift-up lever 27 are bent inward. As a result, the engage pawl 75 of the push-down member 41 engages with the engage portion 85 of the lid 1*b*, holding the push-down member 41 at the slid position. That is, the locked state is released and the lighter is kept unlocked. Then, the auxiliary wheels 25 are rotated and the push-down member 41 is moved further downward. This action rotates the lift-up lever 27 to lift up the nozzle 9, injecting gas, which will be burned by the sparks produced by the file 21 rotating in contact with the flint 17. When the pressure on the push-down member 41 is released to extinguish the fire, the lift-up lever 27 rotates back and the push-down member 41 moves upward and, at the same time, is urged rearward to return to the original position by the returning force of the rail arms 31*a* and 31*b* that has been bend inward. This structure can also provide the same effect as the other embodiments.

An eighth embodiment will be described below referring to FIGS. 43 through 46. In this embodiment, the inclined surface on the bottom side of the push-down member 41 in the seventh embodiment is omitted so that the push-down member 41 has a flat bottom, and the coil spring 83 used in the second embodiment is also used. In this embodiment, the force of the coil spring 83 acts only to lift up the push-down member 41 and the rearward returning of the push-down member 41 is forced by the rail arms 31*a* and 31*b* of the lift-up lever 27 as per the seventh embodiment. That is, the push-down member 41 is returned rearward by the restoring force of the rail arms 31*a* and 31*b* that has been bent inward by the forward sliding of the push-down member 41. This embodiment can also provide the same effect as the above-described individual embodiments.

The present invention is not limited to the above-described embodiments. While a flint is used as ignition means in each embodiment, this invention can also be applied to a so-called electronic lighter. Further, the valve means is in no way limited to the illustrated type. Therefore, the present examples and embodiments are to be considered as illustrative and not restrictive and the invention is not to be limited to the details given herein, but may be modified within the scope of the appended claims.

What is claimed is:

1. A lighter comprising:

a lighter body for storing fuel;

valve means, attached to an upper portion of said lighter body, for stopping injection of said fuel when closed and permitting injection of said fuel when open;

ignition means, provided at said upper portion of said lighter body and activatable as needed to ignite said fuel injected by opening of said valve means;

lift-up means, arranged rotatable via a rotary shaft at said upper portion of said lighter body and having one end connected to said valve means, for allowing said valve means to close when urged in one direction by an elastic member and opening said valve means when rotated in the opposite direction against urging force of said elastic member; and push-down means, provided movable along said lift-up means on a side of the other end thereof, a slide position of said push-down means being properly maintained by means forming a locking relationship with respect to said lighter body or said lift-up means, whereby when said lighter is not in use, said push-down means is kept positioned on said other end side of said lift-up means and has a lower end abutting against said lighter body to set a locked state to restrict a push-down action, as said push-down means is moved along said lift-up means toward said one end thereof, said locked state is released and a position of that movement of said push-down means toward said one end of said lift-up means is maintained by said means forming a locking relationship with respect to said lighter body or said lift-up means, when said push-down means is then pushed down, said means forming a locking relationship is released, said lift-up means is rotated to open said valve means and release said means forming a locking relationship and said ignition means is activated at a same time to ignite said fuel injected through said valve means, and when that downward action of said push-down means is released, said push-down means moves upward to an original state while moving toward said other end of said lift-up means returning by said urging force of said elastic member along said lift-up means.

2. The lighter according to claim 1, wherein:

said lift-up means, which is arranged rotatable via the rotary shaft at said upper portion of said lighter body and having the one end connected to said valve means, has an other end formed into a pair of rail arms, so as to close said valve means when urged in the one direction by said elastic member and opening said valve means when rotated in the opposite direction against the urging force of said elastic member;

said push-down means being provided on the side of said other end of said lift-up means in such a way as to be movable while bending said rail arms inward, the slide position of said push-down means being properly maintained by said means forming a locking relationship with respect to said rail arms of said lift-up means; and further comprising:

restoring means, provided at said top portion of said lighter body, for bending said rail arms inward when said rail arms are rotated by a downward movement of said push-down means, whereby when said lighter is not is use, said push-down means is kept positioned on said other end side of said lift-up means and has the lower end abutting against said lighter body to set the locked state to restrict the push-down action, as said push-down means is moved toward said one end of said lift-up means while bending said rail arms inward, said locked state is released and the position of that movement of said push-down means toward said one end of said lift-up means is maintained by said means forming a locking relationship with respect to said rail arms, when said push-down means is then pushed down, said means forming a locking relationship is released, said lift-up means is rotated to open said valve means and release said means forming a locking relationship and said ignition means is activated at the same time to ignite said fuel injected through said valve means, and with said rail arms being bent inward by said restoring means, when that downward action of said push-down means is released, said push-down means moves toward said other end of said lift-up means to said locked state along said rail arms returning by said urging force of said elastic member.

3. The lighter according to claim 2, wherein said pair of rail arms of said lift-up means have first and second engage pawls formed thereon, while said push-down means has first and second engage portions formed thereon, whereby in said locked state, said first engage pawl engages with said first engage portion to maintain the position of said push-down means, and in an unlocked state, said second engage pawl engages with said second engage portion to maintain the position of said push-down means.

4. The lighter according to claim 2, wherein said pair of rail arms have inclined surfaces on a lighter body side, so that said rail arms are bent inward while sliding against said restoring means through said inclined surfaces.

5. The lighter according to claim 1, wherein:

said lift-up means, which is arranged rotatable via the rotary shaft at said upper portion of said lighter body and having the one end connected to said valve means, has an other end formed into a frame portion, so as to close said valve means when urged in the one direction by said elastic member and opening said valve means when rotated in the opposite direction against the urging force of said elastic member;

said push-down means being provided movable on the side of said other end of said lift-up means, the slide position of said push-down means being properly maintained by said means forming a locking relationship with respect to said lighter body and said frame portion of said lift-up means; and further comprising:

elastic means provided at said upper portion of said lighter body for always urging said push-down means upward, whereby when said lighter is not in use, said push-down means is kept positioned on said other end side of said lift-up means and has the lower end abutting against said lighter body to set the locked state to restrict the push-down action, as said push-down means is moved along said frame portion of said lift-up means toward said one end thereof, said locked state is released and the position of that movement of said push-down means toward said one end of said lift-up means is maintained by said means forming a locking relationship with respect to said lighter body, when said push-down means is then pushed down, said means forming a locking relationship is released, said lift-up means is rotated to open said valve means and release said means forming a locking relationship and said ignition means is activated at the same time to ignite said fuel injected through said valve means, and when that downward action of said push-down means is released, said push-down means moves toward said other end of said lift-up means to said locked state along said frame portion of said lift-up means, which returns by said urging force of said elastic member.

6. The lighter according to claim 5, wherein said push-down means has an engage pawl formed thereon while said lighter body has an engage portion formed thereon comprising said means forming a locking relationship, whereby when said push-down means is forcibly slid down into an unlocked state, said engage pawl engages with said engage portion to keep said unlocked state.

7. The lighter according to claim 6, wherein said engage pawl and said engage portion are each provided with a projection, so that when said push-down means is pushed downward and obliquely forward to release said locked state, said projections hit against each other to restrict the movement of said push-down means and thus restrict that unlocking action.

8. The lighter according to claim 5, wherein that bottom surface of said push-down means where elastic force of said elastic means is an inclined surface, so that said elastic force of said elastic means acts in a direction to move said push-down means to said other end side as well as in an upward direction.

9. The lighter according to claim 1, wherein said ignition means has a pair of auxiliary wheels, so that when said lighter is locked, said auxiliary wheels abut on or engage with said lift-up means to restrict a rotation thereof.

10. The lighter according to claim 1, wherein:

said lift-up means, which is arranged rotatable via the rotary shaft at said upper portion of said lighter body and having the one end connected to said valve means, has an other end formed into a pair of rail arms, so as to close said valve means when urged in the one direction by said elastic member and opening said valve means when rotated in the opposite direction against the urging force of said elastic member; and said push-down means being provided movable along said pair of rail arms of said lift-up means, the slide position of said push-down means being properly maintained by said means forming a locking relationship with respect to said lighter body and rail arms of said lift-up means, whereby when said lighter is not in use, said push-down means is kept positioned on said other end side of said lift-up means and has the lower end abutting against said lighter body to set the locked state to restrict the push-down action, as said push-down means is moved toward said one end of said lift-up means along said rail arms of said lift-up means, said locked state is released and the position of that movement of said push-down means is maintained by said means forming a locking relationship with respect to said lighter body, when said push-down means is then pushed down, said means forming a locking relationship is released, said lift-up means is rotated to open said valve means and release said means forming a locking relationship and said ignition means is activated at the same time to ignite said fuel injected through said valve means, and when that downward action of said push-down means is released, said push-down means moves toward said other end of said lift-up means to said locked state along said rail arms returning by said urging force of said elastic member.

11. The lighter according to claim 3, wherein said pair of rail arms have inclined surfaces on a lighter body side, so that said rail arms are bent inward while sliding against said restoring means through said inclined surfaces.

* * * * *